US006623276B2

(12) United States Patent
Dalmau Ferrerfábrega et al.

(10) Patent No.: US 6,623,276 B2
(45) Date of Patent: Sep. 23, 2003

(54) SAFETY CONNECTOR FOR HOUSEHOLD TABLE-TOP ELECTRICAL APPLIANCES

(75) Inventors: Octavi Dalmau Ferrerfábrega, Barcelona (ES); Félix Pedroso García, Sant Andreu de la Barca (ES)

(73) Assignee: Furas, S.A., Barcelona (ES)

( * ) Notice: Subject to any disclaimer, the term of this patent is extended or adjusted under 35 U.S.C. 154(b) by 0 days.

(21) Appl. No.: 10/032,466

(22) Filed: Jan. 2, 2002

(65) Prior Publication Data

US 2002/0086559 A1 Jul. 4, 2002

(30) Foreign Application Priority Data

Jan. 2, 2001 (ES) ..... 200100001

(51) Int. Cl.[7] ..... H01R 11/30
(52) U.S. Cl. ..... 439/39; 335/205
(58) Field of Search ..... 439/38, 39, 40, 439/106, 101, 108; 335/205, 207

(56) References Cited

U.S. PATENT DOCUMENTS 3,363,214 A * 1/1968 Wright ..... 439/39
3,808,577 A * 4/1974 Mathauser ..... 439/39
4,317,969 A * 3/1982 Riegler et al. ..... 439/39
4,647,120 A * 3/1987 Karabakakis ..... 439/39
6,250,931 B1 * 6/2001 Mendelson ..... 439/39
2002/0160629 A1 * 10/2002 Lau et al. ..... 439/39

FOREIGN PATENT DOCUMENTS

FR 2 696 585 A 4/1994
JP 10-41011 * 2/1998

* cited by examiner

*Primary Examiner*—Tho D. Ta
*Assistant Examiner*—Felix O. Figueroa
(74) *Attorney, Agent, or Firm*—Sughrue Mion, PLLC

(57) ABSTRACT

A safety connector for a table-top household electrical appliance, formed by a socket member (3) mounted in the appliance and a plug member (2) complementary to the socket member (3), and having magnets that allow a plugged-in position to be maintained and separation of both parts under an abnormal strain exerted on the plug member. The socket member (3) comprises pins (14) and a grounding arrangement (20), with a magnet arrangement (15) and two active armatures (16) between them. The plug member (2) comprises two flexible electrical contacts (7), spatially mating with the pins (14). An iron plate member (11) as passive armature is located between the electrical contacts (7) and when making connection, it faces the active armatures (16) of the magnet (15) and makes contact with the ground (20).

9 Claims, 3 Drawing Sheets

SAFETY CONNECTOR FOR HOUSEHOLD TABLE-TOP ELECTRICAL APPLIANCES

DESCRIPTION

1. Field of the Invention

The present invention relates to a safety connector for household table-top electrical appliances, to be precise of the type constituted by an ensemble formed by two parts, one of which is fixed and constitutes a socket member mounted in the appliance, and the other is removable, constitutes an appliance coupler member mating with said socket member, and forms a terminal for an end of a flexible power cord that has at the other end thereof a plug member which may be plugged into an electric mains socket member, there being provided magnetic means allowing a stable mechanical and electrical connection of both parts to be maintained under preset conditions of normal use of the appliance and the mechanical and electrical disconnection of said two parts under an abnormal strain exerted on the appliance coupler member of the ensemble.

2. Prior Art

Safety connectors of the aforementioned type are known wherein the magnetic means, formed by the magnet and the active armatures, are located, in some cases, in the socket member of the household electrical appliance and, in other cases, in the removable part which, as a plug member, is electrically associated with the flexible power cord which is conventionally connected at the other end thereof to a mains socket, the passive armature being located in the other member.

As disclosure of the connectors of the first type, there can be cited the Japanese patent 62-60244, which discloses a female plug socket having an active magnetic arrangement and resilient contacts.

With regard to the connectors of the second type, there can be cited Japanese patent 50-54932 which discloses a female plug member having two differentiated connection stages, Japanese patent 52-05811 which discloses two paths of the power cord, and Japanese patent 62-03914 which discloses an arrangement to protect the magnetic means included in a female plug member from blows caused by accidental falls.

On the other hand, Japanese patent 10-041011 discloses a cord connector that consists of a male plug member having the active magnetic arrangement and which mates with a female plug member that includes the passive magnetic arrangement, constituting a connector for two cords, in which both parts are removable.

In the connectors of the first type, it is observed that they are fixed female type socket members including the active magnetic arrangement, while the connectors of the second type consist of removable female type plug members that include the active magnetic arrangement.

In both the above cases the connectors individually have the following drawbacks: a) the female socket members require that the removable plug members should be provided with connection pins that, projecting out from the insulating body member of the plug member, are susceptible of producing electric discharges or short circuits and of being deformed by blows occurring when accidentally dropped; and b) when the removable plug members are of the female type, they are excessively voluminous and heavy and are susceptible of being damaged if accidentally dropped.

SUMMARY OF THE INVENTION

With the purpose of avoiding such drawbacks the solution has been adopted of structuring a safety connector formed by two parts, a fixed one mounted in the household electrical appliance or similar appliance to be fed electrically and another removable one, removably associated with an electrical outlet, in such a way that the fixed part constitutes a male socket member including the active magnetic arrangement, while the removable part constitutes a female plug member including the passive magnetic arrangement.

According to the foregoing solution, the safety connector of the invention has been developed, which is characterized in that a socket member fixed to the appliance comprises pins, related with the electrical load bearing members of the appliance (heating elements, motors, etc.), and a grounding arrangement, between which there is a magnet arrangement and two active armatures therefor, while a removable plug member, complementary to the fixed socket member, comprises two resiliently flexible electrical contacts spatially mating with the pins of said fixed socket member, and between which there is located an iron plate member as passive armature which, in the positioning and plugging-in operations, is in facing alignment with the active armatures of the magnet and in contact with the grounding arrangement disposed in said socket member.

It is a feature of the invention that the socket member is constituted by a insulating capsular body member fixedly mounted in the appliance, from the bottom of which, there extend the pins and the grounding arrangement disposed against a wall and the magnet and the two active armatures thereof slightly project. It has a hollow section which, being complementary to the solid section of the body member of the removable plug member, is arranged with the open end thereof directed toward the outside of the appliance.

On the other hand, a further feature of the invention is that the removable plug member is constituted by an insulating body member that comprises in the interior thereof the wires of one end of the power cord connected to a fixed point of each one of the resiliently flexible electrical contacts housed in said body member, which are located inside respective passages that debouch in respective openings spatially mating with the pins of the socket member and flank the passive armature iron plate member facing the active armatures of the magnet of said socket member.

Another feature of the invention consists of the resilient electrical contacts having at least one functional part, formed by a strip of resilient conductive material which, shaped in a section including one or more opposed undulations and terminating in a contact flange for engagement with the tip of the pins, is provided in the positioning or un-plugging position, with a greater length than the distance from the fixed point of anchorage of the contacts in the insulating body member to the tips of the pins in the plugged-in position, in which, consequently, the contacts are compressed.

Further features of the invention are: a) the grounding arrangement is formed by a tab arranged on a surface of the wall of the hollow section of the insulating capsular body member; b) the removable plug member, inside the insulating body member, comprises an power cord including, further to the two current bearing wires, a third ground wire that is connected to a fin of the iron plate member forming the passive armature; and c) the grounding tab of the socket member is of such a length as to make contact with the fin of the iron plate member of the passive armature of the removable plug member before the electrical contacts thereof make contact with the pins of the socket member.

The invention contemplates that the contact flange of the resilient electrical contacts is provided with a contact protuberance conformed by stamping or a contact button made from another good electrically conductive metal.

BRIEF DESCRIPTION OF THE DRAWINGS

To facilitate the understanding of the foregoing ideas, there is described hereinafter the object of the invention with reference to the accompanying illustrative drawings, in which.

DETAILED DESCRIPTION OF THE INVENTION

Figure 1:
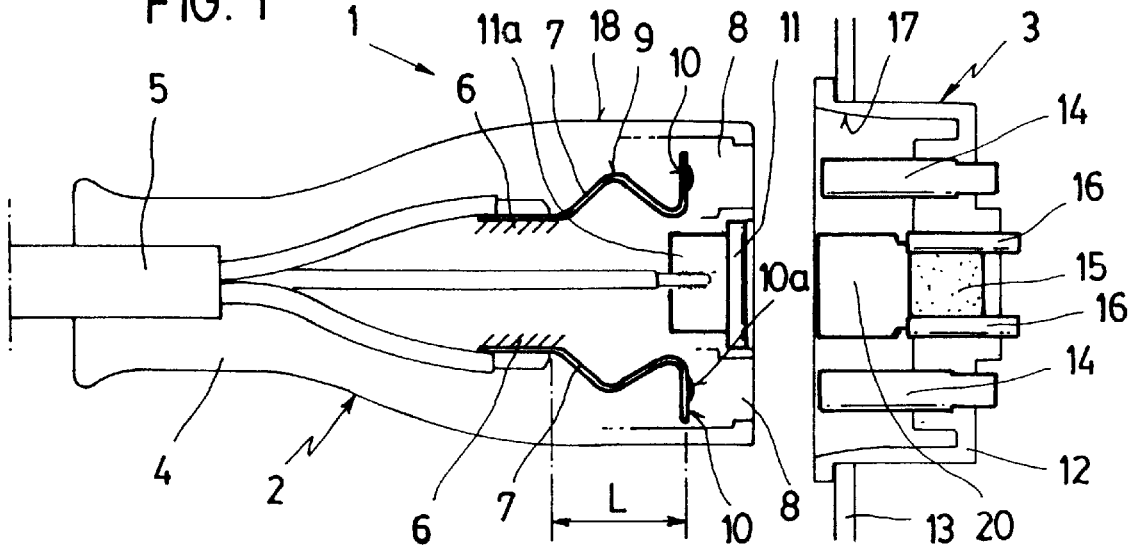
FIG. 1 is a schematic plan view of the removable and fixed parts of a safety connector according to the invention, facing each other in spaced apart position prior to being aligned and/or connected.

One embodiment of a safety connector 1 according to the invention is as shown in the drawings. In the following description the removable part has also been named as removable plug member 2 and the fixed part has also been named as socket member 3.

FIGS. 1 to 6 schematically show both parts of the safety connector 1, with the removable plug member 2 comprising an insulating body member 4 that houses therein the wires of one end of the power cord 5 that are fixedly attached by welding, crimping or other means to a fixed point 6 of each of the electrical contacts 7 that are resiliently flexible and are housed in said insulating body member 4 in respective passages 8.

These electrical contacts are formed by two brass strips or other resiliently flexible material having a portion for anchorage to the insulating body member 4 constituting the fixed point 6, and a functional part shaped with one or more opposed undulations 9 and terminating in a contact flange 10 that it is perpendicular to the axis of the said passages 8.

Between both passages 8, the removable plug member 2 is provided with a passive armature, formed by an iron plate member 11 attractable by a magnet and provided with a fin 11*a* susceptible of sliding over a grounding arrangement 20 of the socket member 3.

Similarly, FIGS. 1 to 6 also show the socket member 3 comprising an insulating capsular body member 12 mounted fixedly in the household electrical appliance 13 from bottom of which there extend pins 14 and the said grounding arrangement 20 and the magnet 15 and the two active armatures 16 thereof slightly project. Body member 12 is provided with a hollow section 17 that, being complementary to the solid section 18 of the insulating body member 4 of the removable plug member 2, has the open end thereof directed toward the outside of the household electrical appliance 13.

As may be seen in FIGS. 1 to 6, the flexible electrical contacts 7 are in correspondence and spatially mating with the pins 14 of the socket member 3.

Figure 2:
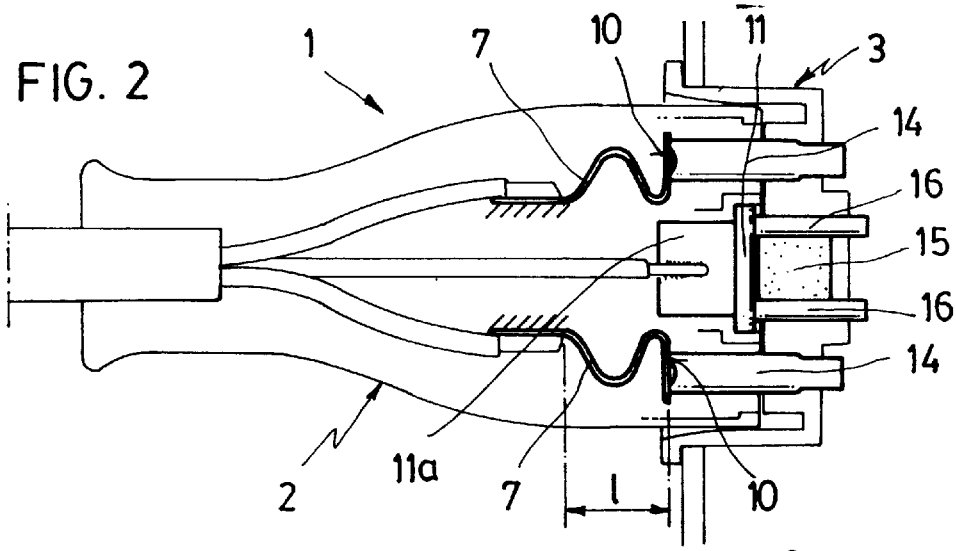
FIG. 2 shows the two parts of FIG. 1 in the plugged in position.

In FIG. 1, wherein the removable plug member 2 is facing, but separated from, the fixed socket member 3, it is to be seen that the resilient electrical contacts 7 have, in the undulating functional part thereof 9, a length L between the fixed point 6 and the flange 10, while in FIG. 2, corresponding to the plugged-in position, the same undulating functional part 9, has a shorter length 1 due to the axial compression of the flexible electrical contacts 7, when being applied by their flanges 10 against the tips of the pins 14, as a result of the attraction exercised by the magnet 15, by means of the active armatures 16 thereof, on the passive armature of the removable plug member 2, such as is the iron plate member 11.

Figure 3:
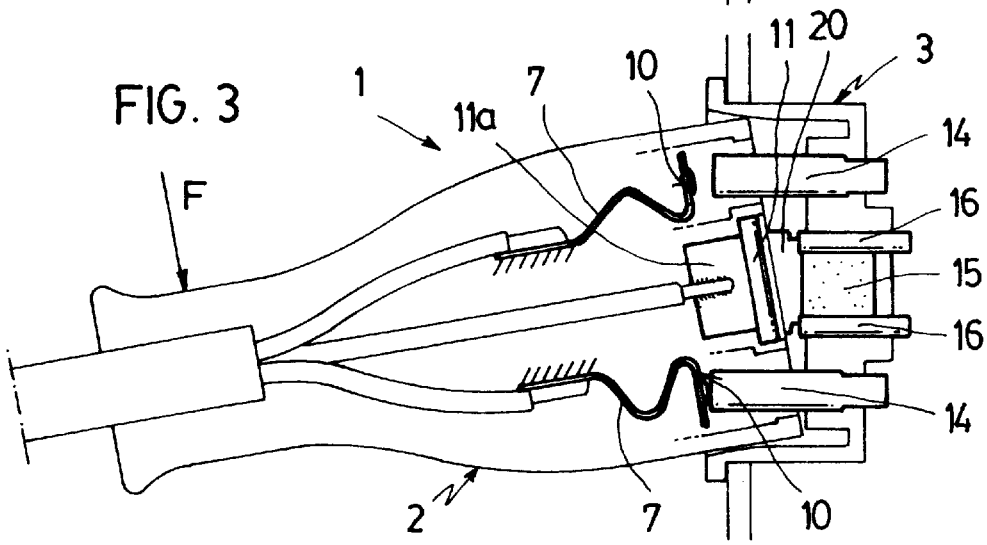
FIG. 3 shows the two parts of FIG. 1 in a position corresponding to an instant of un-plugging with partial disconnection of both parts, as a result of a lateral force accidentally applied to the removable part.
Figure 4:
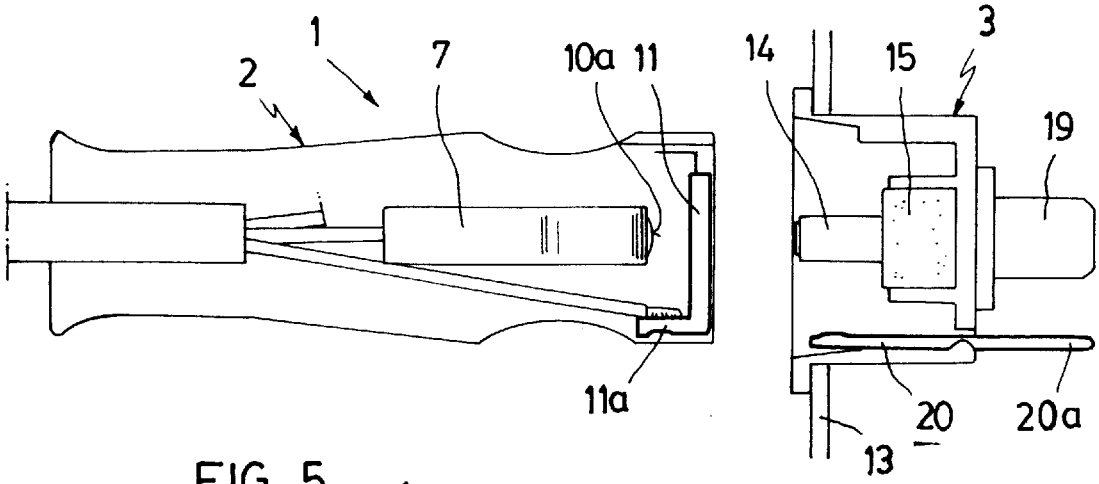
FIG. 4 is a schematic side elevation view, as in the previous figures, of the two parts of the safety connector and in correspondence with the position of FIG. 1.

In FIG. 3, it will be seen how a force F applied on the removable plug member 2 has caused said member to tilt relative to the socket member 3, on overcoming the force of attraction of the magnet 15.

Figure 5:
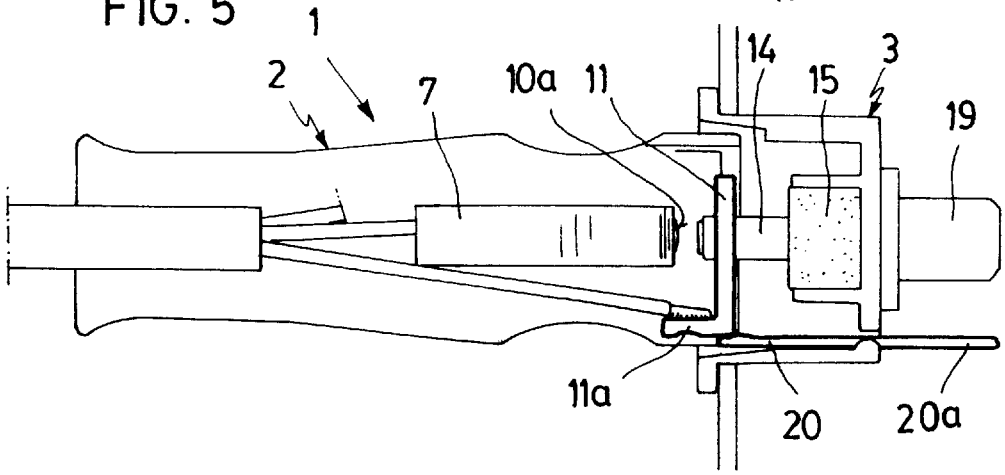
FIG. 5 shows the two parts of FIG. 4 in an aligned position, in which both parts start their mechanical connection, without yet having made electrical contact.
Figure 6:
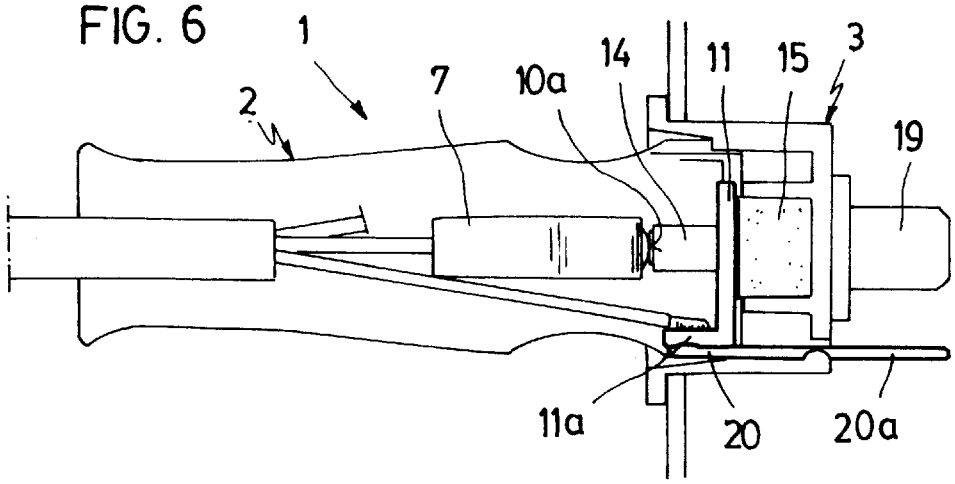
FIG. 6 shows the two parts of FIG. 5, after making electrical connection as illustrated in FIG. 2.

As may be seen in FIGS. 3 and 5, the passive armature formed by the iron plate member 11, connected to the ground wire of the cord 5, is, in a position prior to complete disconnection (FIG. 3) and in the aligned position (FIG. 5), always in contact with the ground 20 that, with the tab 20*a* thereof, is connected to the mass of the household electrical appliance 13, whereby accidental discharges are made impossible.

The flanges 10 of the resilient electrical contacts 7 have a contact point formed by a stamping 10*a* that can be replaced by a riveted button of a good electrically conductive material, such as silver.

Figure 7:
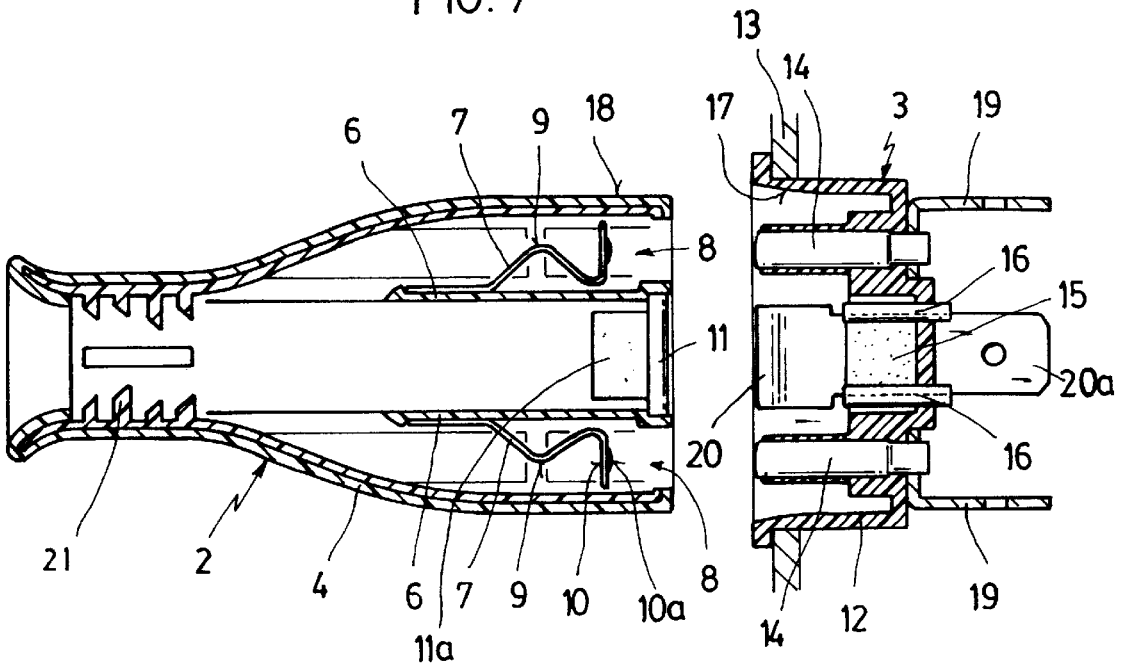
FIG. 7 is similar to FIGS. 1 and 4 and shows a longitudinal section of the two parts of the safety connector, in the unplugged position and according to a embodiment thereof in which the drawing and the number of constituent elements have been simplified relative to a practical embodiment of use.
Figure 8:
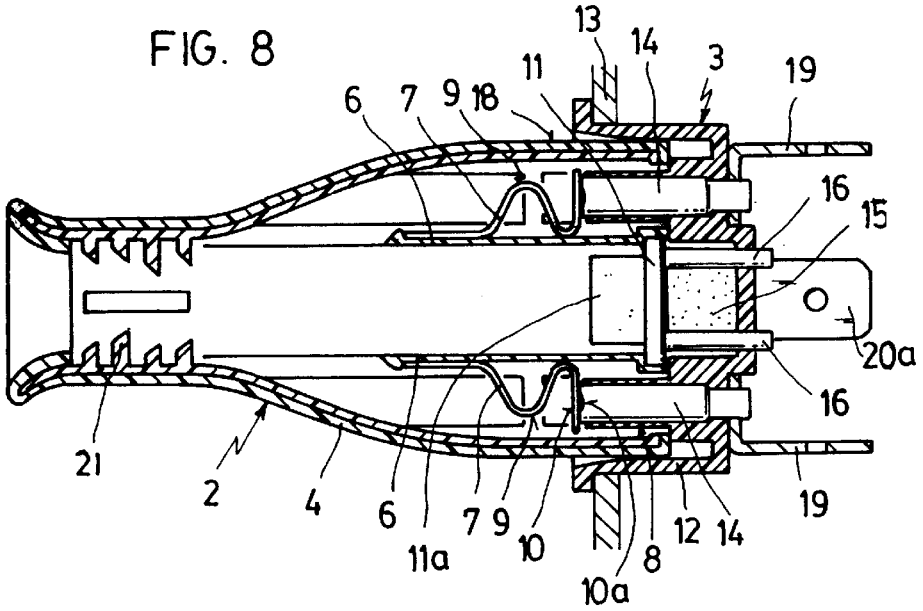
FIG. 8 shows the parts of the safety connector of FIG. 7 in the plugged-in position.

FIGS. 7 and 8 illustrate an embodiment of the safety connector 1 wherein the connection tabs 19 of the pins 14, the connection tab 20*a* of the ground 20 and the retaining protuberances 21 of the electric cord 5 have been shown.

This safety connector 1 is particularly applicable, without thereby excluding other applications, to household table-top electrical appliances containing hot liquids, such as fryers, kettles, coffeepots, teapots and the like, wherein accidental catching of the power cord 5 with the elbow or arm of the user of the appliance, can cause the appliance to overturn or fall with the consequent risk of serious burns for the user.

What we claim is:

1. A safety connector for a household table-top electrical appliance, comprising an ensemble formed by two parts, one of which is fixed and comprises a socket member (3) mounted in the appliance, and the other is removable and comprises a plug member (2) mating with said socket member; said plug member (2) comprises a terminal for an end of a flexible power cord (5), said power cord (5) having at the other end thereof a second plug member which is plugged into an electric main socket member; said socket member further comprises magnetic means allowing a stable mechanical and electrical connection of said plug member and said socket member to be maintained and allowing the mechanical and electrical disconnection of said plug member and said socket member under an abnormal strain exerted on the plug member (2); the socket member (3) comprises pins (14), associated with electrical load bearing members of the appliance, and a grounding arrangement (20), there being situated between said pins (14) (20) a magnet arrangement (15) and two active armatures (16); further the plug member (2) comprises two resiliently flexible electrical contacts (7) spatially mating with a pins (14) of said socket member (3), there being situated between said electrical contacts (7) an iron plate member (11) as passive armature which, in the plugging in operation, is in facing alignment with the active armatures (16) of the magnet (15) and in contact with the ground (20).

2. The connector according to claim 1, wherein the socket member (3) is comprising an insulating capsular body member (12) mounted fixedly in the appliance and from the bottom of which the pins (14) and the grounding arrangement (20) disposed against a wall extend isolatedly and the magnet (15) and two active the armatures (16) thereof slightly project, having a hollow section (17) having an open end thereof directed toward an outside of the appliance, said hollow section (17) being complementary to a solid section (18) of an insulating body member (4) of the plug member (2).

3. The connector according to claim 1, wherein the plug member (2) is comprising an insulating body member (4) that comprises in an interior thereof; wires of one end of the power cord (5) connected to a fixed point (6) of each of the resiliently flexible electrical contacts (7) housed in said insulating body member (4), said electrical contacts (7) being located in respective passages (8) that debouch in respective openings spatially mating with the pins (14) of the socket member (3) and flanking the iron plate member (11) of the passive armature facing the active armatures (16) of the magnet (15) of said socket member (3).

4. The connector according to claim 3, wherein the resilient electrical contacts (7) are provided with at least one functional part formed by a strip of resilient conductive material that is shaped in a portion having one or more opposed undulations (9) and terminating in a contact flange (10) for contacting tips of the pins (14), said electrical contacts (7), being in an unplugged position of said plug member and said socket member, longer than the distance defined between the fixed point (6) of anchorage of the electrical contacts (7) in the insulating body member (4) and the tips of the pins (14) when both parts are in the plugged-in position, whereby, in said plugged-in position, said electrical contacts (7) are compressed against the tips of the pins (14).

5. The connector according to claim 2, wherein the grounding arrangement (20) is comprising a tab (20*a*) arranged on a surface of a wall of the hollow section (17) of the insulating capsular body member (12).

6. The connector according to claim 3, wherein the plug member (2), inside the insulating body member, comprises the power cord (5) further including two current-bearing wires, a third ground wire that is connected to a fin (11*a*) of the iron plate member (11) forming the passive armature.

7. The connector according to claim 5, wherein the tab (20*a*) of the ground (2) of the socket member (3) has such a length as to make contact with the fin (11*a*) of the iron plate member (11) of the passive armature of the plug member (2) before the electrical contacts (7) make contact with the pins (14).

8. The connector according to claim 4, wherein the contact flange (10) of the resilient electrical contacts (7) is provided with a contact protuberance (10*a*) formed by stamping.

9. The connector according to claim 4, wherein the contact flange (10) of the resilient electrical contacts (7) is provided with a contact button of another good electrically conductive metal.

* * * * *